US008555690B2

(12) United States Patent
Codatto

(10) Patent No.: US 8,555,690 B2
(45) Date of Patent: Oct. 15, 2013

(54) PLANT FOR BENDING METALLIC FLAT ELEMENTS SUCH AS PANELS, SHEETS, PLATES OR SIMILAR, BENDING MACHINE FOR SUCH METALLIC FLAT ELEMENTS AND RELATIVE BENDING PROCESS

(75) Inventor: Antonio Codatto, Cologna Veneta VR (IT)

(73) Assignee: Atlantic International Assets S.A., Luxembourg (LU)

( * ) Notice: Subject to any disclaimer, the term of this patent is extended or adjusted under 35 U.S.C. 154(b) by 1320 days.

(21) Appl. No.: 12/074,873

(22) Filed: Mar. 6, 2008

(65) Prior Publication Data

US 2008/0216545 A1 Sep. 11, 2008

(30) Foreign Application Priority Data

Mar. 7, 2007 (IT) ..... UD2007A0052

(51) Int. Cl.
*B21D 11/00* (2006.01)
*B21D 11/20* (2006.01)

(52) U.S. Cl.
USPC ..... 72/319; 72/422

(58) Field of Classification Search
USPC ..... 72/295, 296, 301, 305, 420, 389.3, 320, 72/322, 316, 422, 426, 427, 323
See application file for complete search history.

(56) References Cited

U.S. PATENT DOCUMENTS 5,761,951 A * 6/1998 Codatto ..... 72/420
7,210,328 B2 * 5/2007 Strasser ..... 72/420

* cited by examiner

*Primary Examiner* — Debra Sullivan
(74) *Attorney, Agent, or Firm* — Hedman & Costigan, P.C.; James V. Costigan; Kathleen A. Costigan

(57) ABSTRACT

Plant (10) for bending metallic flat elements (11) including a bending machine (13) provided with a support plane (21) on which the metallic flat element (11) to be bent is positioned, a bending group (19) which bends, upwardly or downwards, a section of the metallic flat element (11), and a sucker feeding group (22) associated with the support plane (21) for selectively feeding the metallic flat element (11) to the bending group (19). The feeding group includes one or more sucker organs (22) aligned in a direction substantially transverse to the metallic flat element (11) to be bent and placed, in the rest position, below the support plane (21), to lift the metallic flat element (11) of a given height (D) from the edge of the support plane (21), after the bending has been carried out.

14 Claims, 6 Drawing Sheets

PLANT FOR BENDING METALLIC FLAT ELEMENTS SUCH AS PANELS, SHEETS, PLATES OR SIMILAR, BENDING MACHINE FOR SUCH METALLIC FLAT ELEMENTS AND RELATIVE BENDING PROCESS

FIELD OF THE INVENTION

The present invention refers to a plant for bending, and eventually shaping, even in a radial type, metallic flat elements, such as panels, sheets, plates and the like, in order to obtain a shaped element according to a predetermined drawing or project. In particular, the plant in accordance with the present invention includes at least one bending machine configured in such a way as to carry out, in the same way, bending directed upwardly or downwards. The present invention also relates to a bending, and in case shaping, process to obtain from said metallic flat elements an element shaped in a prefixed manner.

STATE OF THE ART

They are known automatic plants through which a metallic flat element of the deformable type, for example a panel or a sheet, is bent in order to obtain an element shaped according to a predetermined project scheme.

The known plants include, arranged substantially one aligned to the other, a loading station on which the sheet to be bent is initially placed, a bending machine which performs the bending, or shaping, of the sheet, an evacuation station where the bent sheet is placed, arranged on the opposite side of the loading station, and a translation group suitable to move the sheet to bend, or bent, among the various stations. The translation group is normally provided with a robotized conveyor having grip suckers which allow to collect the sheet from the loading station to carry it through the bending machine and the evacuation station.

The known bending machines substantially include a support plane on which the sheet to be bent is positioned, a blank holder element suitable to block from time to time a section of the sheet against the support plane, a bending group which acts on a free portion of the sheet adjacent to the section blocked by the aforesaid blank holder element, and a feeding group which feeds in a coordinate way the sheet to the bending group to perform the desired bending, of the radial type too.

They are known feeding groups which, through one or more sucker organs placed below or at the edge of the support plane, hold the sheet from the bottom and move it in a coplanar way to the support plane itself.

The bending group normally includes two opposing blades mounted on a cutter block which is operated in one or another direction depending on whether the bending to be carried out is upwardly or downwards. The known bending machines present, however, several drawbacks which especially occur when there is the need to bend downwards a section of the sheet.

Indeed, in the known art, at the end of the bending downwards, the bent part is placed below the edge of the support plane and, therefore, does not actually allow the normal coplanar moving of the sheet on the support plane itself, implying, as a result, complications in the extraction phases of the sheet from the bending group.

Furthermore, to realize bending downwards with closed conformation, such as at "C", the known bending machines require numerous and complex bending steps which, in some cases, may also require the upsetting of the sheet for the finishing of the bending.

Such operations require the manual contribution of highly specialized operators and lengthy and onerous implementation times, not always assuring an optimum bending of the sheet.

Moreover, the known plants for bending provide that the robotized element transports the sheets both in the loading phase to the bending machine, and in the extraction phase from the bending machine, thus involving idle wait times between the extraction phase and the loading of a new sheet to bend. This drawback involves, therefore, a productivity reduction of the machine and of the plant.

Another drawback of the known plants is due to the fact that, if they are provided with the translation group, they are really productive only in condition of automatic handling of the sheets, namely when the translation group is in an active condition.

However, under certain operating conditions where bends are required on sheets initially shaped in a particular way, or superficially provided with indentations and/or holes, the usual transporters present problems in the collection and they are used in a limited way, hence reducing the productivity of the bending machine belonging to the plant.

Such a drawback also determines difficulties in carrying out the routine maintenance operations of the bending machine.

One aim of the present invention is to realize a plant, and get ready a process, for bending metallic flat sheets, which allows to carry out bends downwards, also closed, without complicating the extraction phases of the metallic elements bent by the bending group.

Other aim of the present invention is to build a plant, and get ready a process, for bending metallic flat elements which allows to minimize the idle time of loading and extraction of the metallic elements, optimizing the productivity of the bending machine. Yet another aim of the present invention is to realize a plant, and get ready a process, which can be used in an equally efficient way both with automatic moving of the metallic elements, and with semiautomatic moving of the elements themselves.

To offset the disadvantages of the known art and to obtain this and other aims and advantages, the applicant has studied, tested and produced this invention.

DISCLOSURE OF THE INVENTION

This invention is expressed and characterized in the independent claims.

The dependent claims expose other characteristics of this invention or variations of the main solution idea.

In compliance with the aforesaid aim, a plant for bending metallic flat elements according to the present invention includes at least a bending machine provided with a support plane on which the metallic flat element to be bent is positioned, a bending group suitable to bend upwardly, or downwards, a section of the metallic flat element, and a sucker feeding group associated with the support plane and suitable to selectively feed the metallic flat element to said bending group.

According to one characteristic aspect of the present invention, the feeding group includes one or more sucker organs aligned in a direction substantially transverse to the metallic element to bend and placed, in the rest position, below the edge of the support plane. The sucker organs are configured both for selectively applied to the metallic flat element a traction towards the support plane, and for moving the metallic flat element along substantially coplanar directions with respect to the support plane, and yet for lifting the metallic element of a given height from the edge of the support plane, at least after the bending has been made. In this way, in case, but not only, the bending group carries out a downwards bending of the metallic element, namely below the edge of the support plane at the end of the bending phases, the sucker organs will be moved upwardly in order to lift the metallic element from the support plane until the bent part is completely beyond the edge of the support plane. In this lifted condition of the metallic element it is possible to directly carry out both an handy extraction, and the eventual completion of the bend, for example in case it is given to such a bend a C conformation downwards.

It is clear that, under certain operative conditions, the lifting of the metallic flat element from the support plane can be performed by the feeding group also in the feeding phase, namely before the metallic flat element has already been bent.

With the present invention, it is possible to carry out an easily and fully automated extraction of the metallic element, basically whatever is the type of bending carried out. Furthermore, the lifting movement of the metallic element from the support plane allows to reduce and simplify the steps necessary to make bends, even complex, which normally require the intervention of skilled labour.

In a preferred embodiment of the invention, the plant also includes a loading station on which the metallic flat element to be bent is initially placed, an evacuation station where the metallic bent element is positioned, and a translation group equipped with a sucker robotized conveyor which collects the metallic elements from the loading station to automatically transport and place them on the support plane of the bending machine.

In this embodiment, the plant in accordance with the present invention includes an evacuation cart, positioned downstream the bending machine and equipped with its own evacuation organs, advantageously of the sucker type, which transport the metallic bent element towards an evacuation area of the cart itself.

In this way, while the evacuation organs of the evacuation carriage transport the metallic bent element, the translation group of the plant can be placed simultaneously in its position of collection from the loading station of a new metallic element to be bent. Such condition allows to minimize the idle wait times during automatic loading and unloading of the bending machine.

Advantageously, the evacuation organ of the evacuation carriage is suitable to transport the metallic bent element along a direction substantially orthogonal to the loading direction of the machine. In this way, the plant according to the present invention has an essentially L-shaped layout, with a consequent reduction, on one hand, of the installation size and, on the other hand, with a reduction of the cycle times, since it is possible to superimpose, at least partially, the steps of evacuation of the bent metallic element and loading of a new metallic element to bend.

According to another preferred embodiment of the present invention, the evacuation carriage is selectively movable towards at least one side of the bending machine, in order to allow direct access to the support plane. In this way, the loading of the metallic elements can be carried out in a semi-automatic way or with the intervention of an operator.

This embodiment facilitates both the manual loading operation needed by particular shaping or size of the metallic elements to be bent, and the maintenance operation to be performed on the bending devices.

BRIEF DESCRIPTION OF THE DRAWINGS

These and other features of the present invention will appear clear from the description which follows of a preferred embodiment, given by way of a non limiting example, with respect to the attached drawings in which.

DESCRIPTION OF A PREFERRED EMBODIMENT

Figure 1:
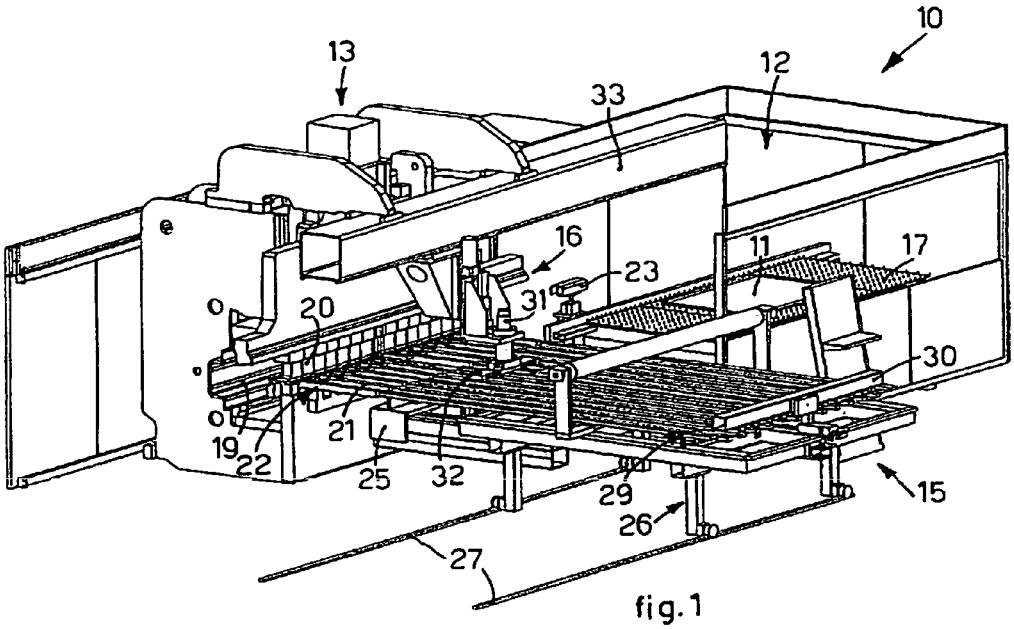
FIG. 1 shows a perspective view of a plant for bending metallic flat elements in the rest condition.
Figure 2:
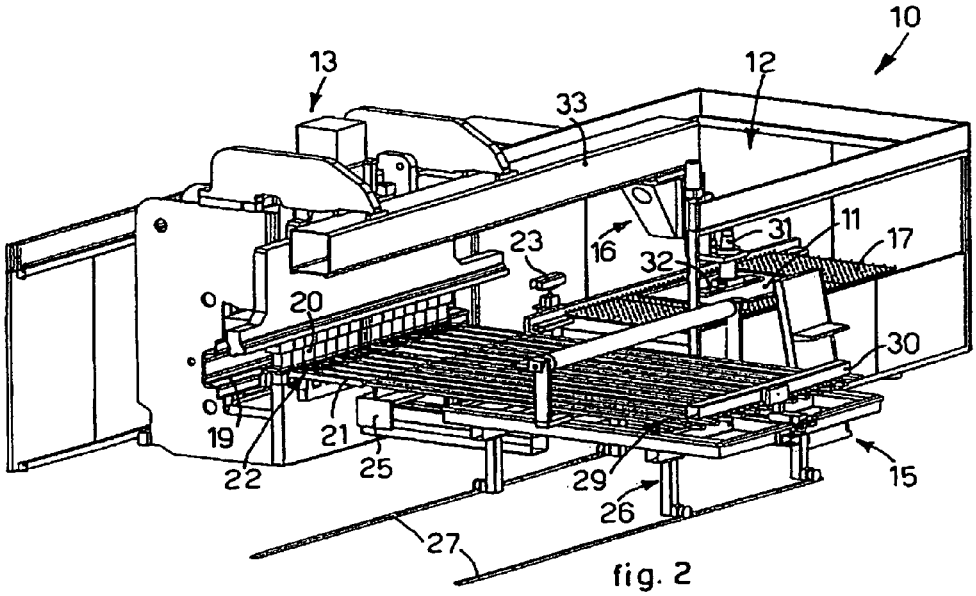
FIG. 2 shows a perspective view of the bending plant of FIG. 1 in a first operative condition.
Figure 3:
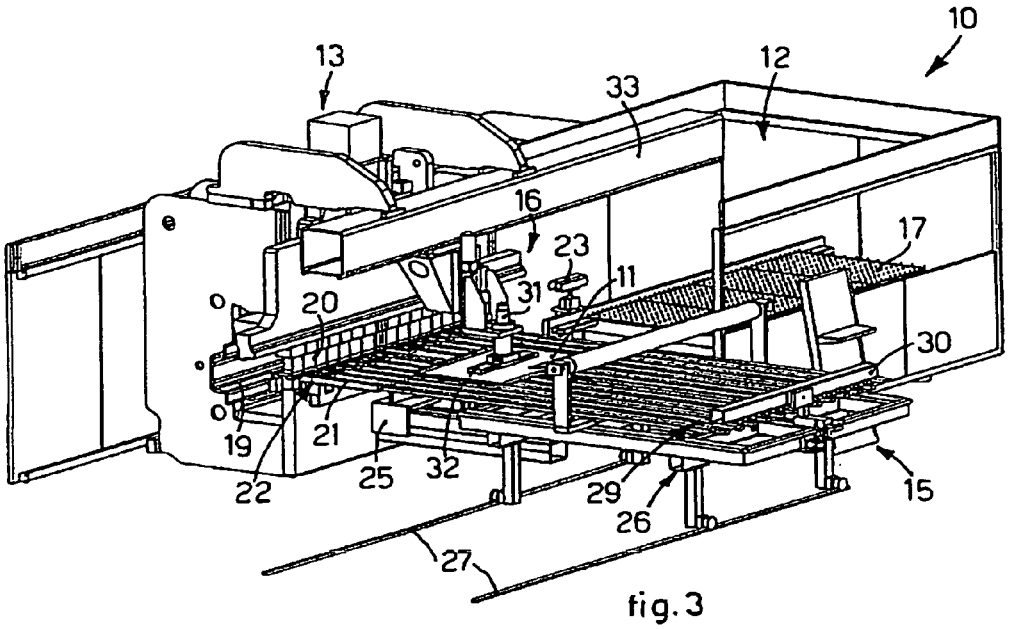
FIG. 3 shows a perspective view of the bending plant of FIG. 1 in a second operative condition.
Figure 4:
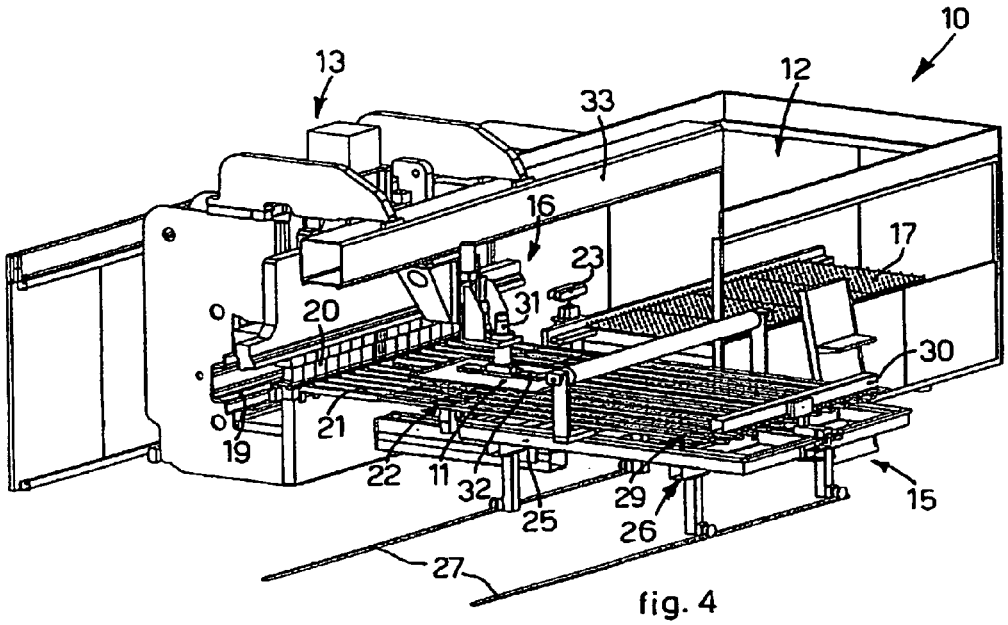
FIG. 4 shows a perspective view of the bending plant of FIG. 1 in a third operative condition.
Figure 5:
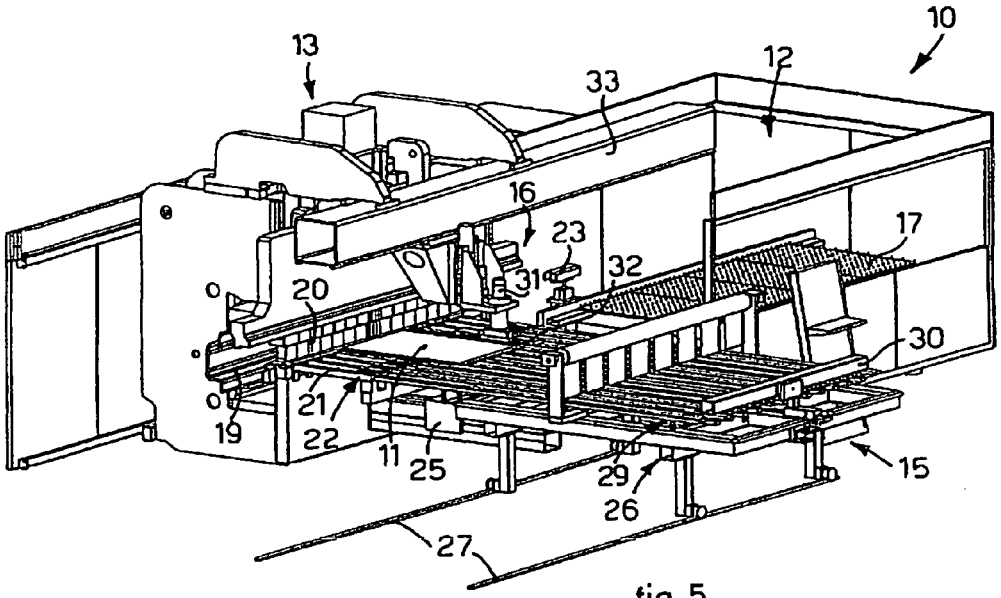
FIG. 5 shows a perspective view of the bending plant of FIG. 1 in a fourth operative condition.
Figure 6:
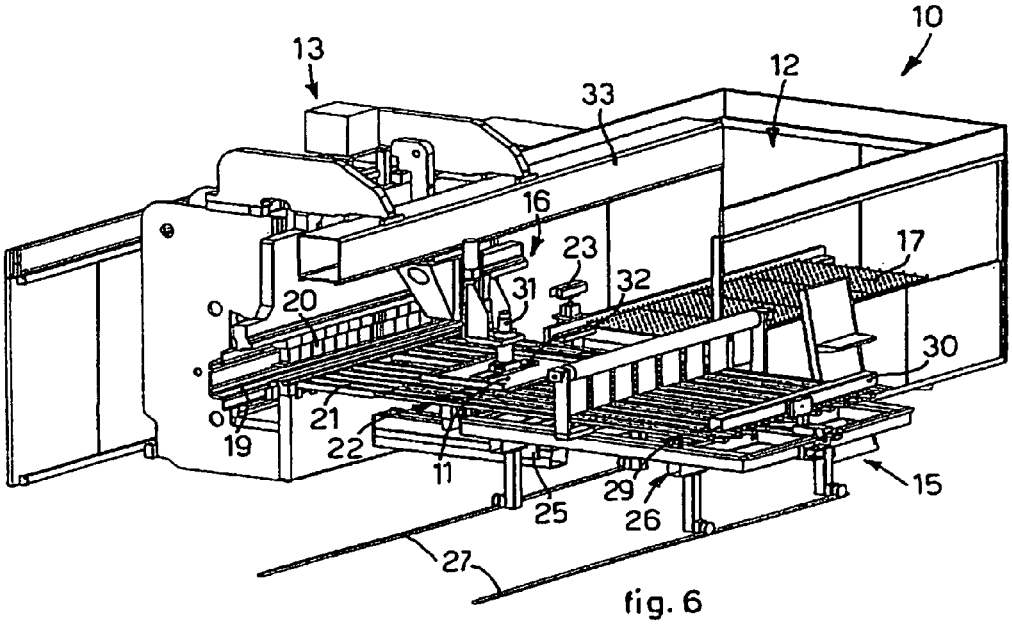
FIG. 6 shows a perspective view of the bending plant of FIG. 1 in a fifth operative condition.
Figure 7:
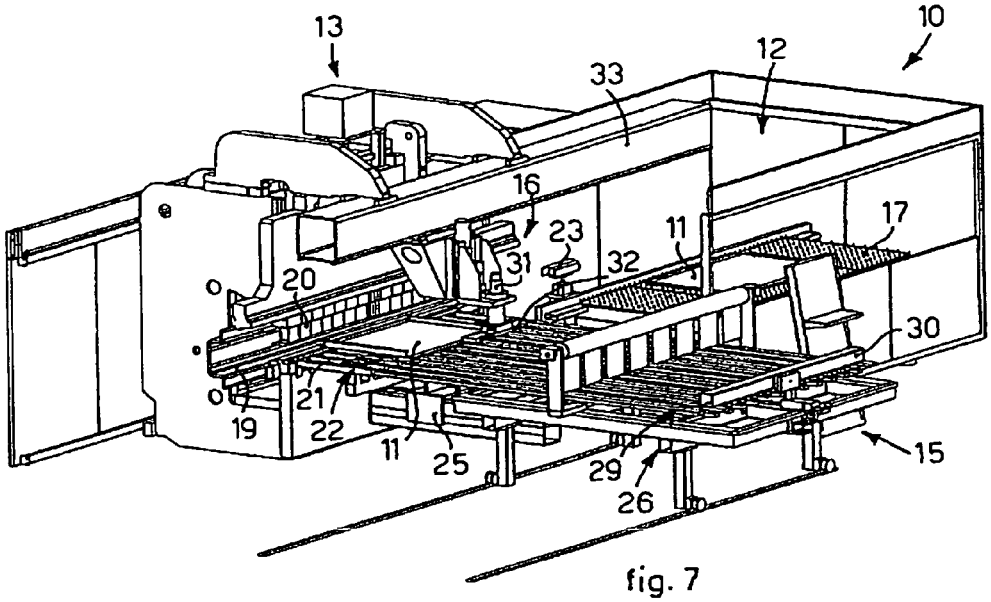
FIG. 7 shows a perspective view of the bending plant of FIG. 1 in a sixth operative condition.

With reference to the attached figure, it is shown as a whole a plant 10 for bending metallic flat elements, in the specific case a sheet 11.

In particular, the plant 10 includes a loading station 12, aligned to which there is a bending machine 13, downstream of which an evacuation station 15 is provided.

The plant 10 according to the invention also comprises a translation member 16 which transports the sheet 11 from the loading station 12 to the bending machine 13, and sets it out in the correct position of bending.

The loading station 12 includes substantially a positioning bench 17, on which the sheets 11 to bend are arranged.

The bending machine 13 includes at least one bending group 19, a blank holder arm 20 and a support plane 21, substantially horizontal and associated with a plurality of sucker feeding organs 22 which hold the sheet 11 from the bottom to keep it sticking to the support plane 21. Such feeding organs 22 are also movable with respect to the support plane 21, so as to feed or extract the sheet 11 from the bending group 19 along directions substantially coplanar the support plane 21, and/or to lift it from the support plane 21.

In this case, the bending machine 13 also includes a telecamera 23, for example of the digital type, connected to an electronic processing unit, to shoot an area of bending and lead the bending group 19 during the bending phases of the sheet 11. An example of such a camera 23 is described and claimed in the U.S. Pat. No. 7,055,355 in the name of the applicant.

The bending group 19 is of the substantially known type and it is neither described nor illustrated in detail. By way of example, the bending group 19 traditionally includes two shaped blades suitable to act on a free section of the sheet 11 to carry out the bend thereof upwardly or downwards. Also the blank holder arm 20 is of the traditional type and can be selectively equipped depending on the size of the sheet 11 and/or on the bending to be executed on such a sheet 11.

In this case, the support plane 21 is composed of a plurality of section bars placed substantially parallel one each other and reciprocally spaced apart and oriented along the direction of feeding/extraction of the sheet 11.

The feeding organs 22 are connected one to another and are arranged alternately and normally coplanar the section bars which compose the support plane 21, in order to define a single supporting plane for the sheet 11 and to retain the latter sticking to the support plane 21.

The feeding organs 22 are connected to a relative moving organ 25, which is disposed below the support plane 21 and is designed to move the feeding organs 22, whether in approaching the bending group 19, or in departing from the bending group 19, or upwardly, so as to lift the sheet 11 of a given height "D" from the edge of the support plane 21.

Such a lifting is particularly advantageous if a bend of the sheet 11 is carried out downwards. In this case, indeed, the lifting of the sheet 11 enables to bring the bent part above the edge of the support plane 21, thus, allowing the fully automatic extraction of the sheet 11 itself from the bending group 19.

It is clear that such a lifting of the sheet 11 may be equally carried out also in the phase of feeding the sheet 11 to the bending group 19, namely before the desired bend.

Figure 13:
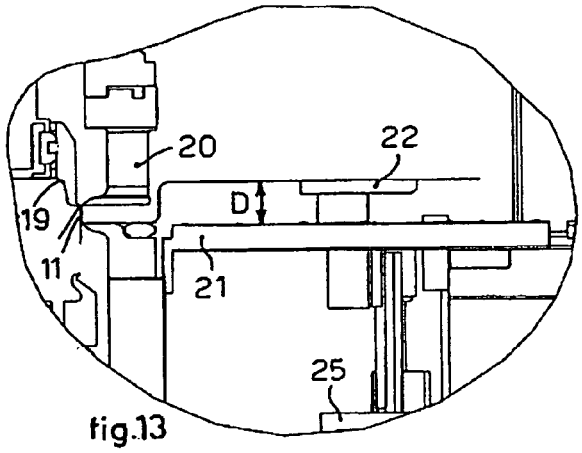
FIG. 13 shows an enlarged side view of the bending plant of FIG. 1 in a bending phase of a sheet.

This lifting is even more advantageous in case complex bends downwards have to be realized on the sheet 11 (FIG. 13).

In such case, the solution according to the present invention allows to carry out "on air" bends, i.e. without maintaining the sheet 11, at least for a section, sticking to the support plane 21, thus enabling to fully perform the bend quickly and effectively, without the need of numerous, complex and repeated placements of the sheet 11 itself.

The evacuation station 15 substantially includes an evacuation carriage 26 practically positioned in continuation with the support plane 21 and also composed by a plurality of section bars substantially parallel and spaced apart one each other.

Figure 10:
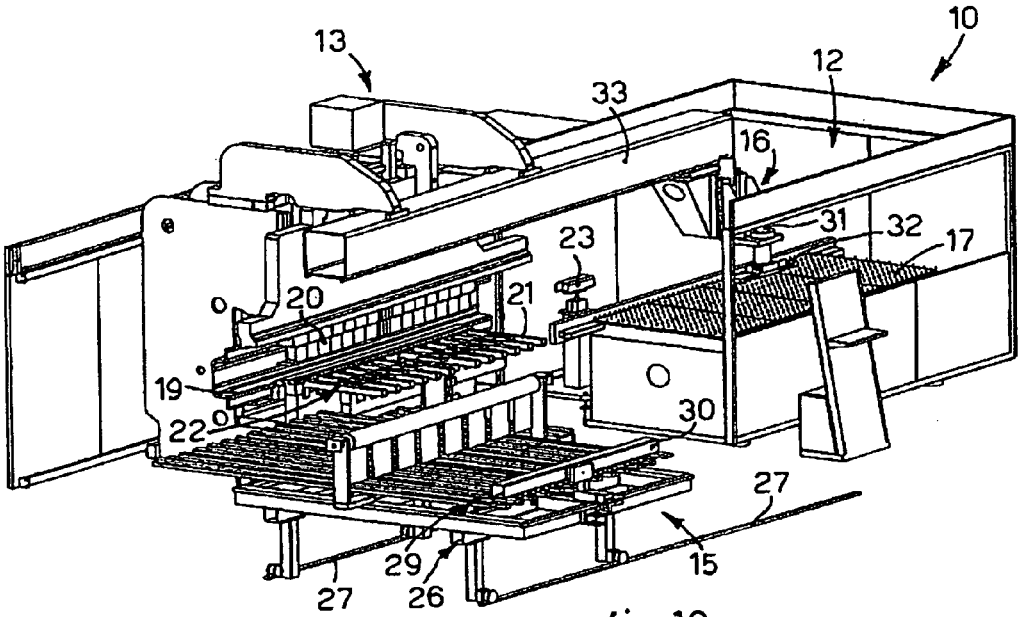
FIG. 10 shows a perspective view of the bending plant of FIG. 1 in a ninth operative condition.
Figure 11:
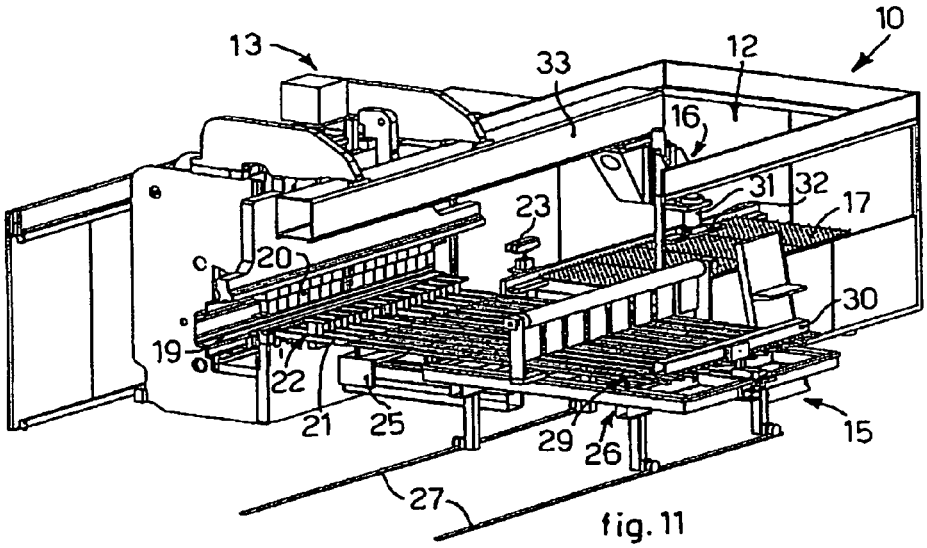
FIG. 11 shows a perspective view of the bending plant of FIG. 1 in a tenth operative condition.
Figure 12:
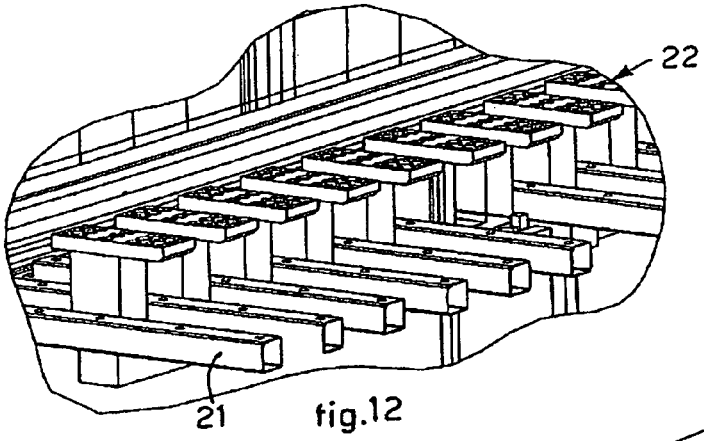
FIG. 12 shows an enlarged particular of FIG. 11.

The evacuation carriage 26 is located on two rails 27 where can slide, in order to be selectively placed between an active position, aligned with the support plane 21 (FIGS. from 1 to 9), and a passive position (FIG. 10), in which is moved sideways from the support plane 21 and allows direct access to the latter, whether for the maintenance of the bending machine 13, or for the loading of sheets 11 of particular size, shape and/or bends.

The evacuation station 15 also includes a plurality of sucker evacuation organs 29, arranged alternately and coplanar the section bars which form the evacuation carriage 26, and movable longitudinally to the evacuation carriage 26, through a relative moving member 30, so as to collect the sheet 11 bent and extracted from the bending group 19, and bring it to a certain area of evacuation.

The translation member 16 includes a robotized arm 31 of Cartesian type mounted slidingly on a guide bridge 33 and provided with a sucker tool 32 suitable to collect the sheet 11 from its top surface to lift it initially from the positioning bench 17 and carry it up to the support plane 21.

The sucker tool 32 is designed to rotate of about 360° with respect to the rest of robotized arm 31, so that it can selectively orient the sheet 11 with respect to the feeding direction of the latter, on the basis of the bend to be carried out.

Furthermore, the sucker tool 32 includes two side parts which can be selectively rotated upwardly, in order to allow, from time to time, the selective variation of the configuration of the sucker tool 32, according to the size and/or the shaping of the sheet 11 to transport.

With reference to the operative sequence shown in FIGS. from 1 to 9, the functioning of the plant 10 according to the present invention is as follows.

At the beginning a sheet 11 is set up, either manually or automatically, on the positioning bench 17 of the loading station 12.

Afterwards, the robotized arm 31 is moved, so that its sucker tool 32 collects the sheet 11 from the positioning bench 17 and transport it to the support plane 21. At this point the sucker tool 32 rotates of about 90° for correctly orienting the sheet 11 and then puts the sheet 11 itself down on the support plane 21 where the feeding organs 22 keep it sticking to the latter. The same feeding organs 22 feed the sheet 11 to the bending group 19 of the bending machine 13, so that the planned bend is carried out. Once the bending is finished, the feeding organs 22 extract the sheet partially bent from the bending group 19 and bring it back in cooperation with the robotized arm 31, so that the latter can again orient the sheet 11 and arrange it for a new bend. Such a sequence of feeding, bending, extraction and orientation, is repeated for all the bends planned on the sheet.

As previously mentioned, in case in which, but not only, a bend of the sheet 11 is carried out downwards, the moving organs 25 determine the lifting of the feeding organs 22, and then of the sheet 11, from the support plane 21, up to the surmounting of the edge of the support plane, in order to realize the possible completion of the bends "on air", and allow the feeding organs 22 to be moved in extraction without complications, or accidental collisions among the parts.

Once the last bend planned on the sheet 11 is carried out, the latter is positioned by the feeding organs 22 near the evacuation carriage 26, so that the evacuation organs 29 may retain the bent sheet 11 with their respective sucker and transport it to the evacuation zone of the evacuation carriage 26.

Figure 8:
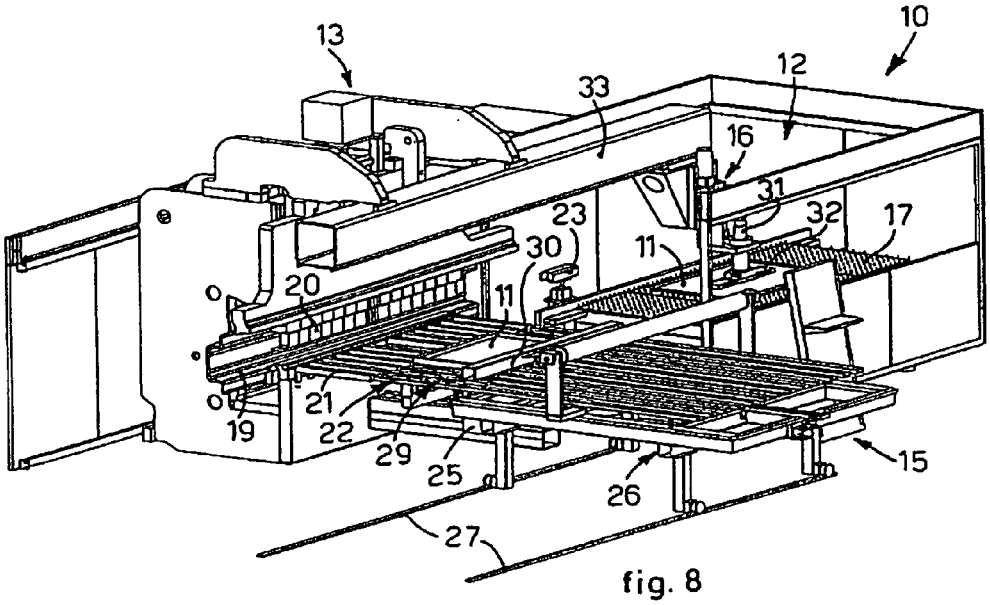
FIG. 8 shows a perspective view of the bending plant of FIG. 1 in a seventh operative condition.
Figure 9:
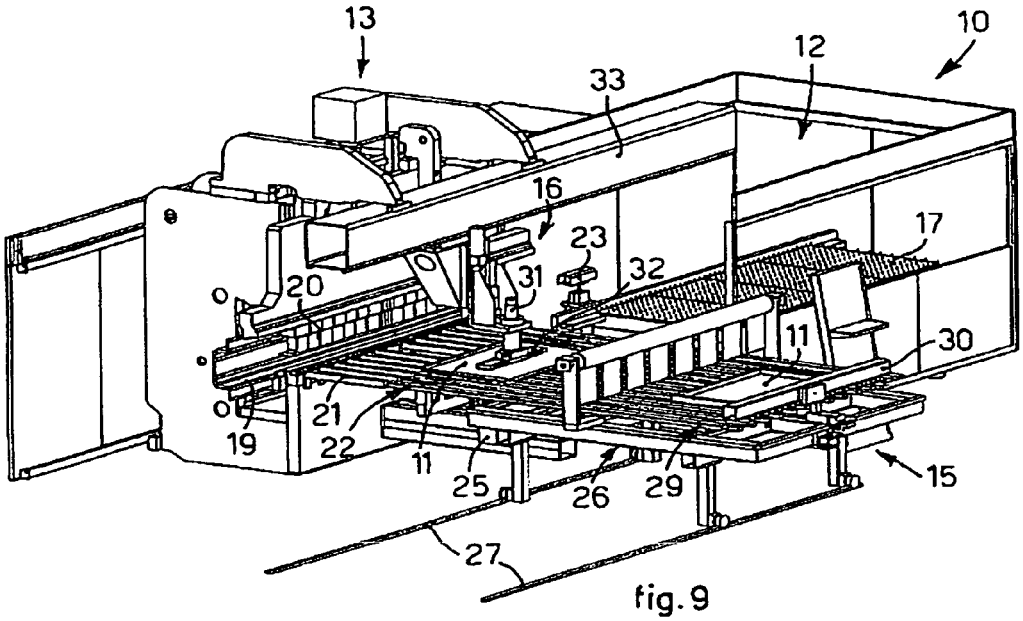
FIG. 9 shows a perspective view of the bending plant of FIG. 1 in an eighth operative condition.

With particular reference to the FIGS. 8 and 9, simultaneously to the transport of the bent sheet 11 to the evacuation area of the evacuation carriage 26, the robotized arm 31 picks from the positioning bench 17 a new sheet 11 to be bent.

This solution enables thus to substantially eliminate the idle time, in the prior art, due to the need to wait for the complete evacuation of the bent sheet 11 before the charging of a new sheet 11.

However, it is clear that modifications and/or additions of parts, or steps, can be yielded to the plant 10, the machine 13 and the relative operating process till now described, without for this reason going out of the scope of the present invention.

It is also clear that, although the present invention has been described with reference to specific examples, a skilled man in the art will carry out other equivalent embodiments of the plant for bending metallic flat elements, such as panels, sheets, plates or similar, of the bending machine for these metallic flat elements and of the relative process of bending, having the specific characteristics expressed in the claims and thus falling within the protection scope defined by them.

The invention claimed is:

1. Bending machine for a metallic flat element (11), including a support plane (21) on which said metallic flat element (11) to be bent is suitable to be positioned, a bending group (19) suitable to bend upwardly, or downwards, a section of said metallic flat element (11), and sucker feeding group associated with said support plane (21) and suitable to selectively feed said metallic flat element (11) to said bending group (19), characterized in that said sucker feeding group includes more than one sucker organ (22) aligned in a direction substantially transverse to said metallic flat element (11) to be bent and placed, in the rest position, below said support plane (21), and suitable at least to lift said metallic flat element (11) a given height (D) from the edge of said support plane (21) to keep said metallic flat element (11) from sticking to the support plane (21), at least after the bending has been carried out.

2. Machine as to claim 1, characterized in that said sucker feeding group (22) is also suitable to apply to said metallic flat element (11) a traction towards said support plane (21), and/or to move said metallic flat element (11) along directions substantially coplanar with respect to said support plane (21).

3. Machine as to claim 1, characterized in that said machine has more than one sucker organ, (22) connected to each other and said more than one sucker organ 22 being moved in a coplanar way and/or in lifting way with respect to said support plane (21), by a moving organ (25) placed below said support plane (21).

4. Machine as defined in claim 1 characterized in that said support plane (21) includes a plurality of section bars substantially parallel and spaced apart one each other, said sucker feeding organs (22) are interposed among said section bars.

5. Process for bending a metallic flat element (11) by using a machine according to claim 1, said process including at least a first phase of positioning said metallic flat element (11) to be bent on said support plane (21), a second phase of feeding said metallic flat element (11) to the bending group (19), a third phase of bending upwardly, or downwards, a section of said metallic flat element (11), through said bending group (19), and a fourth, phase of extracting said metallic flat element (11) from said bending group (19) by means of said sucker feeding group, characterized in that at least at the end of said third phase or in said fourth phase, said sucker feeding group is moved to lift said metallic flat element (11) of a given height (D) from the edge of said support plane (21).

6. A plant for bending metallic flat elements (11) comprising at least one bending machine (13) according to claim 1.

7. A plant for bending metallic flat elements which comprises at least one bending machine according to claim 1 wherein said sucker organs (22) are also suitable to apply to said metallic flat element (11) a traction towards said support plane (21), and/or to move said metallic flat element (11) along directions substantially coplanar with respect to the support plane (21).

8. A plant for bending metallic flat elements which comprises at least one bending machine according to claim 1 wherein said plant also includes a loading station (12) arranged upstream of said bending machine (13) and in which said metallic flat element (11) to be bent is suitable to be placed, and a translation group (16) positioned above said loading station (12) and said bending machine (13), and suitable both to transport said metallic flat element (11) from said loading station (12) to said bending machine (13), and to properly prepare said metallic flat element (11) for bending.

9. A plant for bending metallic flat elements according to claim 8 wherein said loading station (12) includes at least a positioning bench (17) on which said metallic flat element (11) is suitable to be set up.

10. A plant for bending metallic flat elements according to claim 8 wherein said translation group (16) includes a robotized arm (31) mounted slidingly on a guide bridge (33) and provided with a rotating sucker tool (32), which is suitable to collect said metallic flat element (11) from its top surface.

11. A plant for bending metallic flat elements according to claim 8 wherein said sucker tool (32) includes at least one side wall which can be selectively rotated upwardly.

12. A plant for bending metallic flat elements which comprises at least one bending machine according to claim 1 characterized in that said plant also includes an evacuation station (15) disposed downstream said bending machine (13) and suitable to evacuate said metallic flat bent element (11).

13. A plant as to claim 12, characterized in that said evacuation station (15) includes at least one evacuation carriage (26) aligned with said support plane (21) of said bending machine (13) and provided with its own evacuation organs (29) suitable to transport said metallic flat bent element (11) towards an evacuation zone.

14. A plant for bending metallic flat elements according to claim 13 wherein said evacuation carriage (29) can be selectively moved laterally with respect to said bending machine (13), so as to allow direct access to said support plane (21).

* * * * *